US007912414B2

(12) United States Patent
Catalá-Civera et al.

(10) Patent No.: US 7,912,414 B2
(45) Date of Patent: Mar. 22, 2011

(54) MICROWAVE AND ELECTROMAGNETIC PRINTING AGENT HEATING DEVICE

(75) Inventors: José M. Catalá-Civera, Valencia (ES); Frank-Michael Morgenweck, Kiel (DE); Domingo Rohde, Kiel (DE); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 831 days.

(21) Appl. No.: 11/572,723

(22) PCT Filed: Jul. 12, 2005

(86) PCT No.: PCT/EP2005/007527

§ 371 (c)(1),
(2), (4) Date: Oct. 11, 2007

(87) PCT Pub. No.: WO2006/010467

PCT Pub. Date: Feb. 2, 2006

(65) Prior Publication Data

US 2008/0089725 A1 Apr. 17, 2008

(30) Foreign Application Priority Data

Jul. 29, 2004 (DE) ..... 10 2004 036 827

(51) Int. Cl.
*G03G 15/20* (2006.01)

(52) U.S. Cl. ..... 399/336

(58) Field of Classification Search ..... 399/335, 399/336

See application file for complete search history.

(56) References Cited

U.S. PATENT DOCUMENTS

| | | | | |
|---|---|---|---|---|
| 4,187,405 | A | 2/1980 | Puschner et al. | |
| 4,435,072 | A * | 3/1984 | Adachi et al. | 399/336 |
| 4,456,368 | A * | 6/1984 | Isaka et al. | 399/336 |
| 4,482,239 | A * | 11/1984 | Hosono et al. | 399/336 |
| 4,511,778 | A | 4/1985 | Takahashi et al. | |
| 6,587,665 | B2 | 7/2003 | Bartscher et al. | |
| 6,608,987 | B2 | 8/2003 | Bartscher et al. | |
| 7,606,522 | B2 * | 10/2009 | Rohde et al. | 399/336 |
| 2002/0106226 | A1 | 8/2002 | Morgenweck et al. | |

FOREIGN PATENT DOCUMENTS

| | | |
|---|---|---|
| DE | 100 64 561 | 6/2002 |
| EP | 0 942 457 | 9/1999 |
| EP | 1 411 397 | 4/2004 |
| GB | 2 350 321 | 11/2000 |
| JP | 57 177158 | 10/1982 |

* cited by examiner

*Primary Examiner* — William J Royer

(74) *Attorney, Agent, or Firm* — Lawrence P. Kessler; Christopher J. White

(57) ABSTRACT

A heating device for heating at least one printing agent on a printing material which is moved along a transport path through said heating device includes a microwave applicator. A microwave absorber element is located in an outer perimeter of the microwave applicator. The microwave absorber element is an irradiation device that absorbs microwave radiation and emits electromagnetic radiation. The electromagnetic radiation can be applied to the printing agent or the printing material.

11 Claims, 6 Drawing Sheets

MICROWAVE AND ELECTROMAGNETIC PRINTING AGENT HEATING DEVICE

Figure 1:
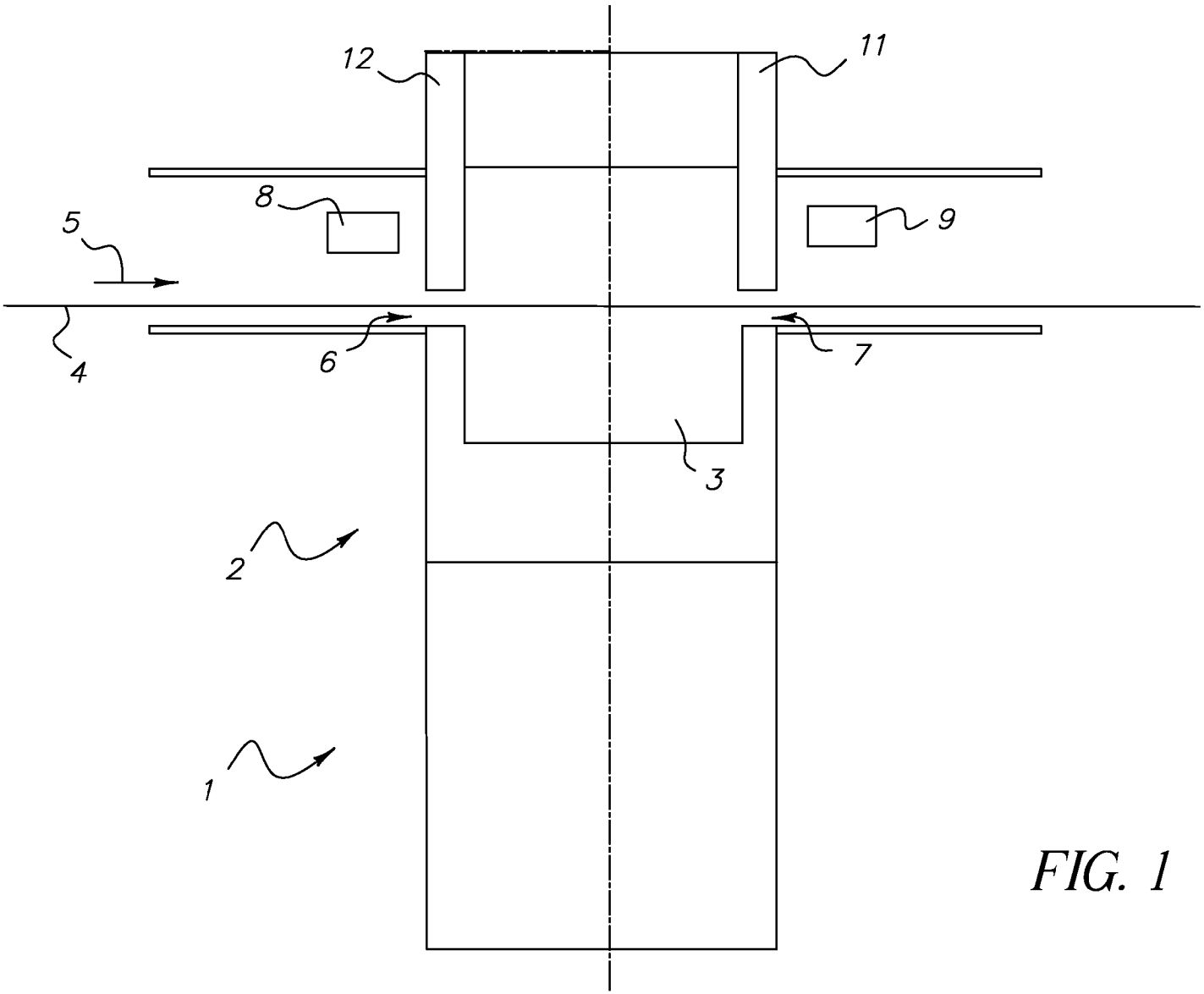

The invention relates to a method and a heating device for heating at least one printing agent on a printing material, which is passed along a transport path through the heating device, comprising at least one microwave applicator and at least one microwave absorber element in the outer perimeter of the microwave applicator.

Virtually any printing process involves the application of solid or liquid printing agents such as dyes, inks, lacquers or toners to a printing material. As the printing process progresses, either liquid printing agents or components thereof must be evaporated, or the solid printing agents or components thereof must be fused to the printing material.

Various contacting or non-contacting processes have been known for heating the printing material and/or the printing agent. In one contacting process, for example, the toner is fused with the use of pressure and heat to the printing material during the fixing process by means of two rollers, whereby one or both of said rollers may be heated.

DE 26 45 765 B1, for example, discloses a non-contacting process, whereby microwaves are used in order to fuse the toner to the printing material fixing it thereon.

When microwaves are used for heating a printing material or a printing agent layer on a printing material, the problem arises that the microwave radiation essentially heats the printing material. In so doing, the printing agent on the surface of the printing material is essentially heated indirectly via the heated printing material. If, for example, toner that has already been fixed is passed through a microwave device in this manner, the toner may be fused again because the printing material is heated. This is a problem, in particular in duplex printing, because the printing material must be heated to at least a temperature that is sufficient to fuse the toner to the second side of the printing material. This makes preventing damage to the image on the first side of the printing material expensive.

When the microwave device is used for heating surfaces or printing agents inside a printing machine, there always is radiation leakage, i.e., microwave radiation exits from the microwave device. Such radiation leakage always occurs at the feeding and ejection openings of the microwave device for printing material. DE 103 39 649, for example, discloses so-called choke structures or filter structures, which at least reduce the intensity of outward-emitted microwave radiation, and further discloses microwave absorber elements, which at least partially absorb exiting microwave rays.

Microwave radiation exiting from the microwave applicator of the heating device, which applies microwave radiation to the printing material or the printing agent is released into the environment unless counter-measures are taken, this being permissible only within specific technical safety limits and being noticeably disruptive to the electronics of a printing machine that comprises the heating device. If counter-measures are taken, radiation leakage is prevented and may no longer affect people or machines. The power of this microwave radiation exiting from the microwave applicator is lost to the heating process in any event. Counter-measures may include, e.g., absorber elements which absorb rays leaked by the microwave applicator.

Thus, the object of the present invention is to provide a heating device and a method of the aforementioned type, which at least reduces the loss of energy due to microwave radiation exiting from the microwave applicator.

Considering the device, the object of the invention is achieved in that the minimum of one microwave absorber element is an irradiation device that absorbs microwave radiation and emits electromagnetic radiation. By means of this irradiation device, the absorbed microwave radiation can be utilized for the heating process, e.g., a fixing process. The absorbed microwave radiation can be converted into electromagnetic radiation which acts, e.g., directly on the printing agent. This electromagnetic radiation should preferably range within a spectral region having wavelengths between 10 nm and 10 μm.

Considering the method, the object is achieved in that the exiting microwave radiation is absorbed by a microwave absorber element configured as an irradiation device, in that the irradiation device is energized by microwave radiation and that, as a result of being energized, said irradiation device emits electromagnetic radiation, in that the electromagnetic radiation emitted by the irradiation device is directed at the printing agent and/or the printing material, and in that at least the heating process is aided by the electromagnetic radiation emitted by the irradiation device and applied to the printing agent and/or the printing material.

The heating process, for example, may be a fixing process for toner, a drying process for lacquers or inks, or the like.

In a preferred embodiment, the irradiation device is a gas-discharge lamp. Favorably, it is possible for the gas of the gas-discharge lamp to be excited by the absorbed microwave radiation for emission of electromagnetic radiation.

In order to heat the printing agent on the printing material by means of the emitted radiation, the emitted radiation ranges substantially within the visible or infrared regions of the spectrum. Considering the device, it is advantageous to arrange the irradiation device in the zone of the transport path of the printing material upstream of the microwave applicator. Then, the printing agent can be preheated and, favorably, less microwave energy is required to fuse the printing agent or allow the printing agent to evaporate partially. Overall, the degree of effectiveness of the heating device is improved.

An alternative or a supplementary feature is that the electromagnetic radiation emitted by the irradiation device is essentially ultraviolet radiation (hereinafter referred to briefly as UV radiation). Considering the device the irradiation device is provided as a supplementary or alternative feature in the region of the transport path of the printing material downstream of the microwave applicator. The UV radiation, for example may additionally enhance a fixing process which is at least aided by the heating device. As a result of the wavelength of this radiation, the printing agent, e.g., a toner is affected directly, so that the printing agent dries better or is fused to the surface of the printing material.

A modification of the invention provides that the UV radiation uses a cross-linking agent. This printing agent is chemically changed by the UV radiation of an irradiation device in such a manner that it cross-links on the surface of the printing material. Advantageously, this printing agent is not again partially melted due to thermal effects during subsequent printing and/or heating processes. In this manner, a printed image can be produced which is more durable and remains easily stable even during a duplex-printing process. Even when the printing material is again strongly heated by microwave radiation to fuse newly applied printing agents, the already cross-linked printing agent is not affected further.

In particular, in a preferred embodiment, infrared radiation or radiation in the visible region of the spectrum is directed by a first irradiation device located upstream of the microwave applicator, and UV radiation is directed by a second irradiation device located downstream of the microwave device, at the printing agent or the printing material. Then, ideally, the heating process is enhanced, in which case energy is not lost due to microwave radiation emitted upstream or downstream of the microwave applicator; at least the emitted energy quantity is reduced.

Depending on the type of printing agent or printing agent density or printing agent thickness on the printing material, different intensities of radiation emitted by the irradiation device may be necessary, because, unlike microwave radiation, such intensities act directly on the printing agent. Therefore, it is advantageous that the field strength of the microwave radiation exiting from the microwave applicator acting on the irradiation device is adapted to the required intensity of electromagnetic radiation acting on the toner. For example, this is possible in that the intensity of microwave radiation that is radiated into the microwave applicator is increased or decreased.

To achieve this adaptation of electromagnetic radiation, at least one adjustment element for changing the microwave radiation acting on the irradiation device is provided in accordance with the present invention. For example, this adjustment element may be a lever or a software-implemented function which affects the field strength of the microwave radiation radiated into the microwave applicator.

A modification of the invention provides that the adjustment element is a diaphragm rotating about the irradiation device. Depending on the desired intensity of the microwave radiation acting on the irradiation device, the irradiation device can be deactivated.

An alternative or supplementary embodiment provides that the adjustment element is a panel that can be adjusted in a direction vertical to the printing material in order to adjust the slit height of the slit through which the transport path is guided through the microwave applicator. Consequently, in accordance with the inventive method, the slit height of the slit is varied in order to adapt the field strength of the microwave radiation acting on the irradiation device. The intensity of the microwave radiation exiting from the microwave applicator is a function of the slit height of this opening, which is required to guide the printing material through the microwave applicator. Advantageously, this intensity can be affected by changing the slit height. It is particularly favorable to enlarge the slit height for control purposes, in order to have available sufficient microwave energy for the irradiation device. Until now, microwave power was lost through this opening and now, in particular, this energy can be utilized well. By regularly increasing the slit height, jams or collisions of the printing material with the panels of the microwave applicator can be better prevented in an advantageous manner.

Another advantageous embodiment provides that at least one adjustment element is a filter element that can be adjusted in a direction vertical to the transport path of the printing material. Such a filter element may also be referred to as a choke element and may be provided in addition to, or as a replacement of, absorber elements in the microwave applicator zone in order to filter out microwave radiation and to prevent microwave radiation from exiting. If such filter elements are provided in the radiation device perimeter, such filter elements reduce the microwave power acting on the irradiation device. By adjusting the filter element, the microwave power acting on the irradiation device can be favorably adjusted to the conditions at hand.

Another favorable embodiment provides that the adjustment element be an adjustable coupling element extending from the microwave application zone of the microwave applicator. Due to this coupling element, the region directly in the outer perimeter of the microwave applicator, i.e., in the region of the irradiation device, and the microwave application zone are electromagnetically coupled with each other in a favorable manner. Depending on the adjustment of the coupling element, more or less microwave radiation—in accordance with the required intensity—enters the zone of the irradiation device.

To achieve this, the method advantageously provides that at least one coupling element is adjusted in order to stop the microwave radiation from the microwave applicator.

An advantageous embodiment uses an electrical conductor as the coupling element. For example, a metal pin may couple the application zone with the irradiation device zone.

In particular, the electrical conductor is configured so as to slide and, depending on required intensity, can be slid in and out of the microwave applicator.

An alternative embodiment provides a diaphragm as the coupling element. In addition, the method provides that the opening size of the aperture of the diaphragm is decreased or increased. In this manner, the desired intensity of microwave radiation exiting from the microwave applicator can be adjusted.

The field strength of the microwave radiation exiting from the microwave applicator decreases with increasing distance of the openings or the slits of the microwave applicator from the plane of the transport path of the printing material. Consequently, it is advantageous that, in order to adapt the field strength of the microwave radiation acting on the irradiation device, the irradiation device be moved to positions of different field strengths.

In accordance with the invention, it is advantageous to use a gas-discharge lamp as the irradiation device.

Such gas-discharge lamps are readily available and relatively durable when used and can advantageously emit in the desired wavelength range, depending on the respective type of electromagnetic radiation.

Depending on the density or the pressure of the gas inside the gas-discharge lamp, the gas absorbs more or less microwave radiation; at the same time, appropriately more or less intense electromagnetic radiation is emitted through the irradiation device. Therefore, in order to adapt the radiation intensity acting on the printing agent on the surface of the printing material, the invention advantageously provides that gas-discharge lamps with different gas pressures be used. The radiation intensity acting on the printing agent can then be advantageously adapted to the thickness or density of the printing agent.

Depending on the composition of the gas inside the gas-discharge lamp, the gas absorbs more or less microwave radiation; at the same time, correspondingly more or less intense electromagnetic radiation is emitted by the irradiation device. Furthermore, also the wavelength range of the emitted radiation may be shifted or distributed in a spectrally different manner. Therefore, in order to adapt the radiation intensity or the radiation spectrum acting on the printing agent on the surface of a printing material, it is advantageous if gas-discharge lamps using different gas compositions are used. The radiation intensity or the radiation spectrum acting on the printing agent can then be advantageously adapted to the thickness or density and/or the type of printing agent.

The gas-discharge lamp is biased, its absorption behavior, and hence its emission behavior, can be affected by the level of the bias. Initially, as has surprisingly been found, more microwave radiation is absorbed by a biased gas-discharge lamp. Furthermore, it is possible, if the intensity of the electromagnetic radiation emitted due to the absorption of microwave radiation is insufficient for the desired application to the printing agent on the printing material, to increase the bias of the gas-discharge lamp to a level such that the intensity of the emitted radiation is adapted to existing requirements. Consequently, in accordance with the invention, it is advantageous if the gas-discharge lamp is biased and, in so doing, the lamp is already energized. The gas-discharge lamp, which has been energized in this manner, achieves an improved degree of effectiveness of the heating device, because leakage radiation is absorbed even better by the heating device and converted into useful electro-magnetic radiation.

An alternative embodiment provides that an electrode-free gas-discharge lamp be used. As a result of this, advantageously, a failure of the gas-discharge lamp due to burned-out electrodes can no longer occur. The gas of the gas-discharge lamp is then substantially excited by the microwave energy exiting from the microwave applicator for the emission of electromagnetic radiation.

The invention further provides that toner is used as the printing agent. Advantageously, a fixing process using microwave radiation can be used to fuse this toner to the surface of a printing material. The microwave radiation is applied to the printing material by the microwave applicator of the heating device of the fixing device. Advantageously, upstream of the microwave applicator, the toner can be preheated by an inventive irradiation device using electromagnetic radiation, for example in the infrared region of the spectrum. Furthermore, the toner may be fused to the printing material advantageously with the aid of UV radiation, which, for example, acts on the toner through an inventive irradiation device downstream of the microwave applicator. If, even more advantageously, the toner can be cross-linked by UV radiation, the toner is chemically changed by UV radiation downstream of the microwave applicator in such a manner that a cross-linked toner image is formed, this image not being melted again even during a duplex printing process, for example. Consequently, the inventive heating device and the inventive method produce a more stable printed image.

Embodiments of an inventive heating device, which could even lead to additional inventive features but do not constitute a restriction of the scope of this invention, are shown by the drawings.

They show in

Figure 2:
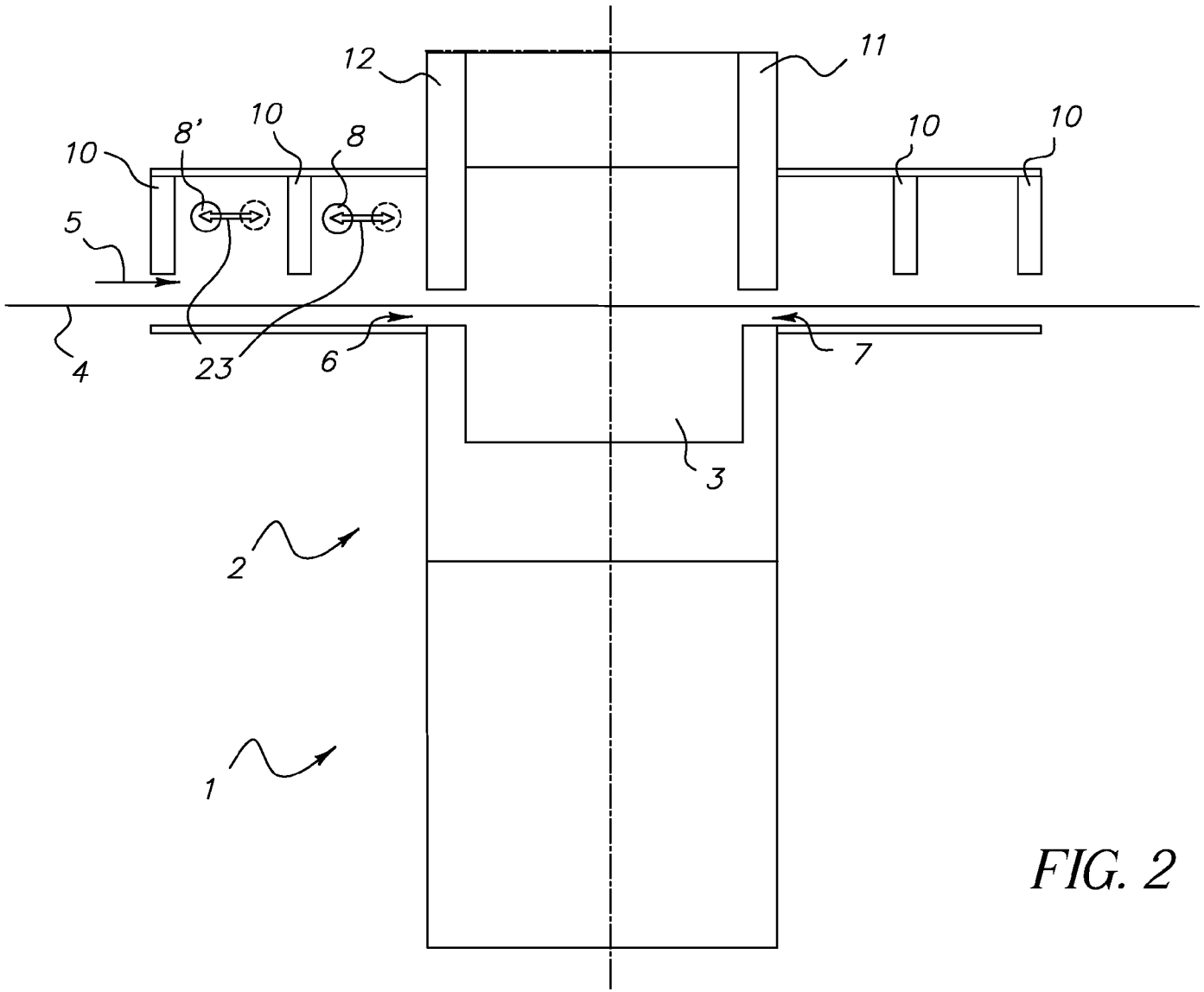
Figure 3:
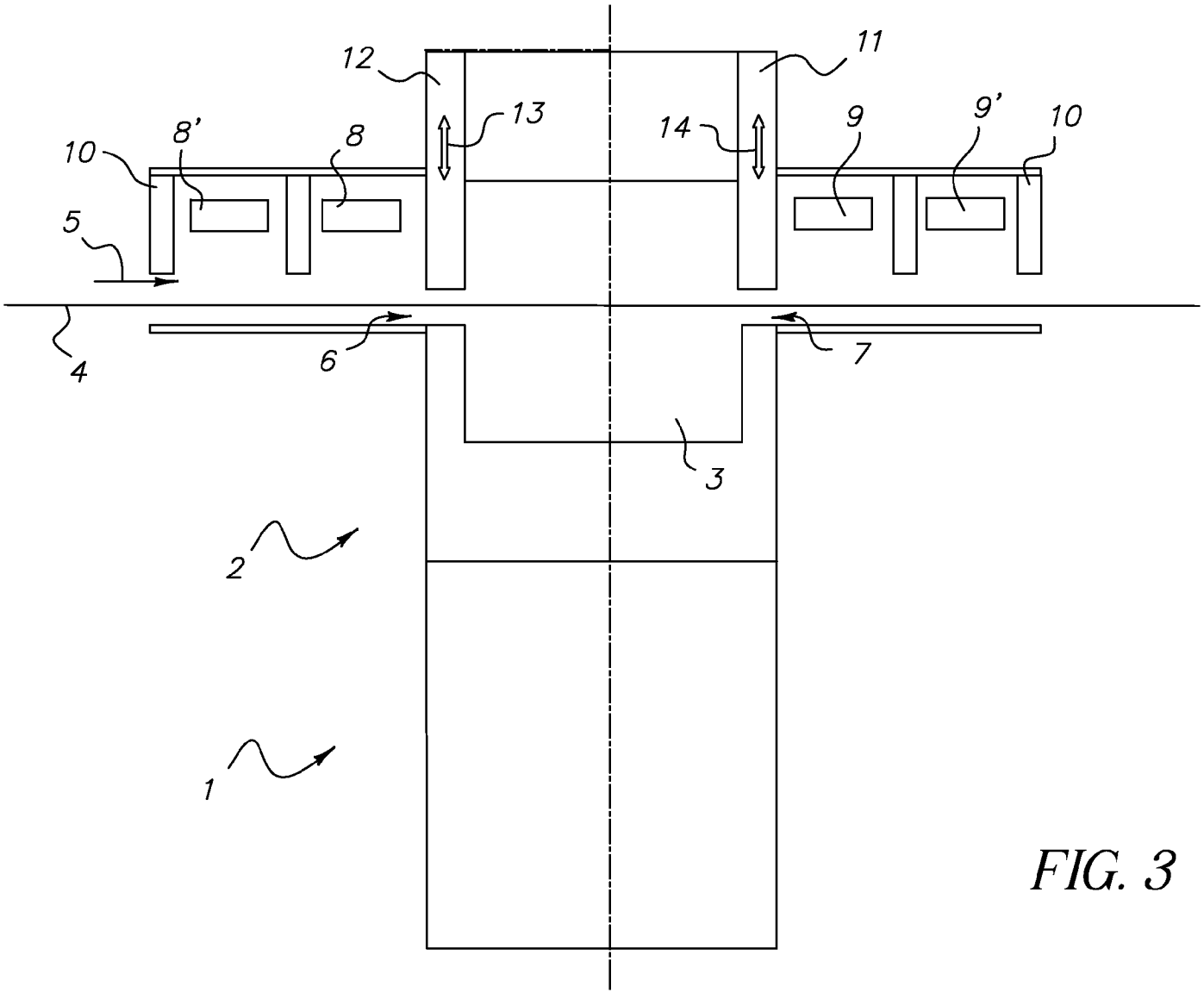
Figure 4:
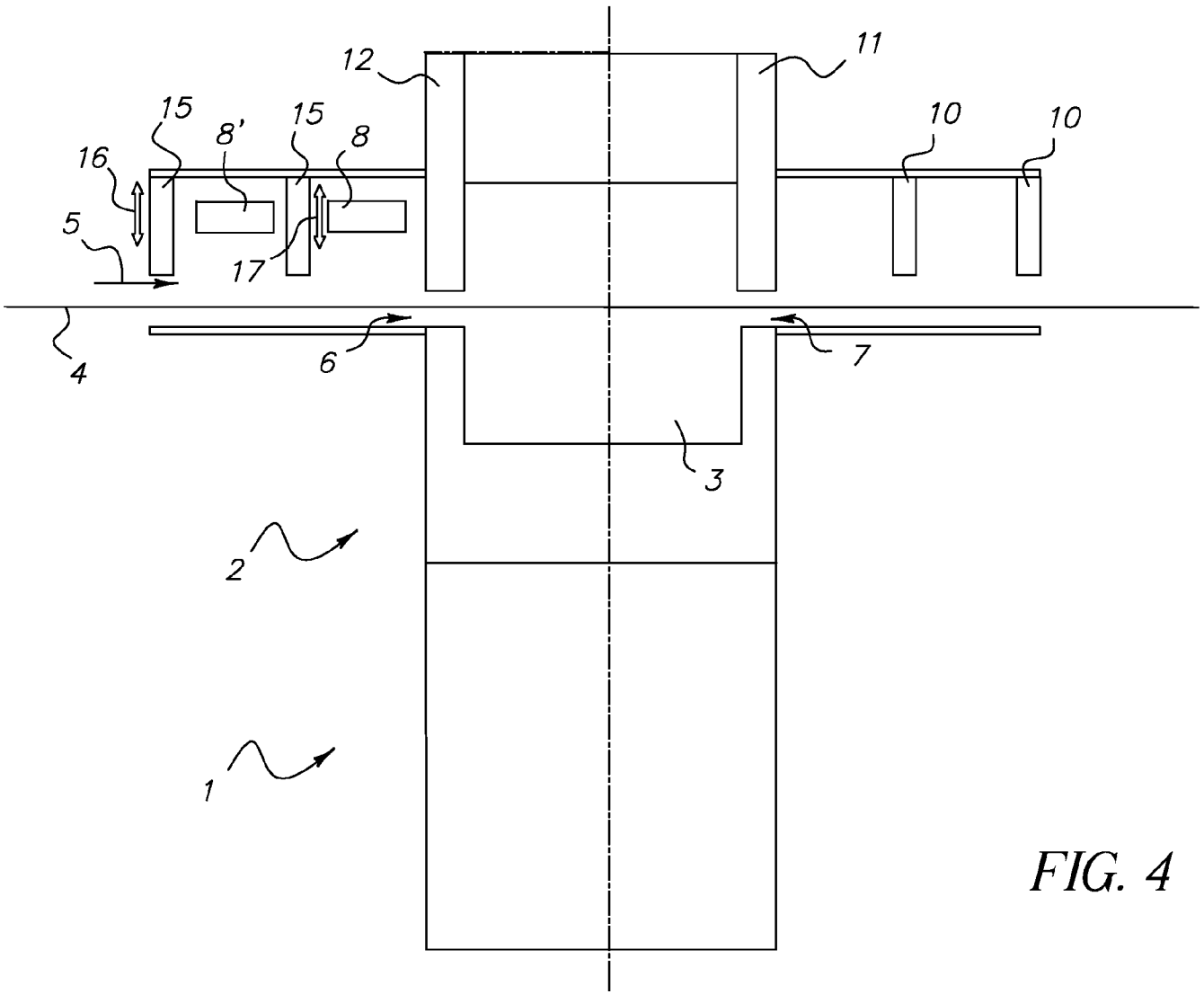
Figure 5:
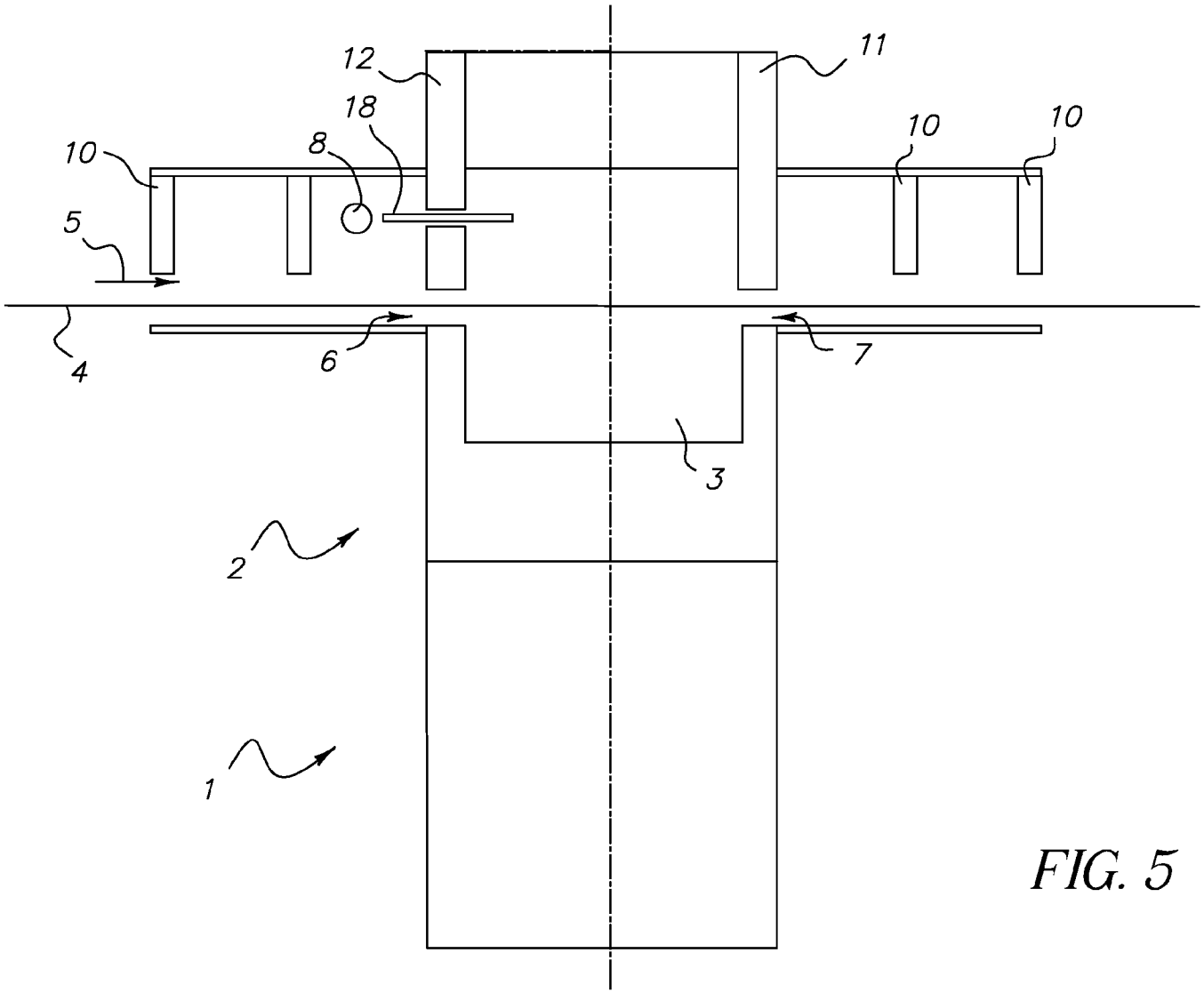
Figure 6:
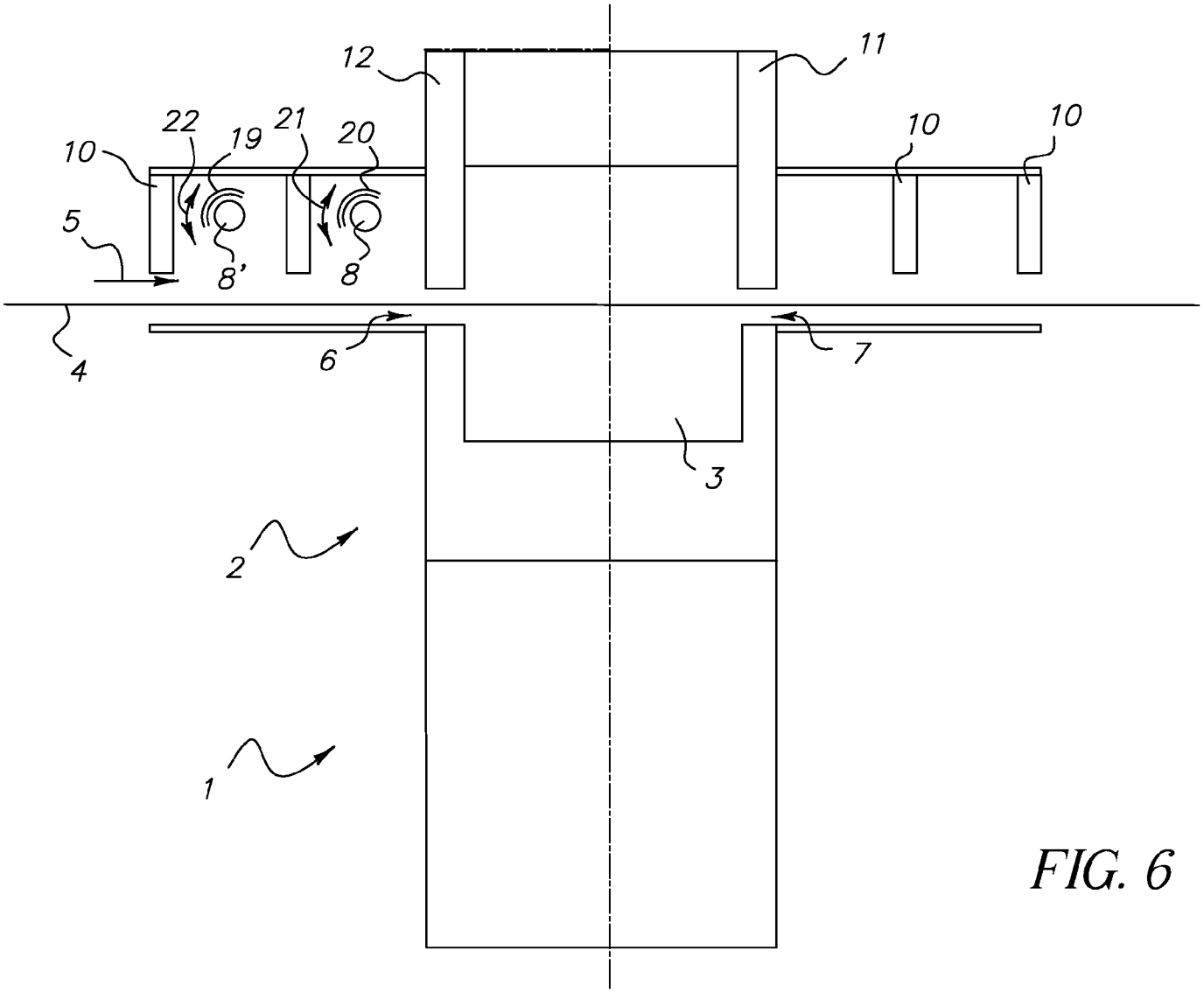

FIG. 1 a heating device with absorber elements configured as gas-discharge lamps;

FIG. 2 a heating device with absorber elements configured as sliding gas-discharge lamps;

FIG. 3 a heating device with sliding panels of a microwave applicator;

FIG. 4 a heating device with sliding filter elements;

FIG. 5 a heating device with a coupling element; and,

FIG. 6 a heating device with diaphragms that partially enclose gas-discharge lamps.

FIG. 1 is a schematic illustration of a side elevation of a heating device which, as depicted, is configured as a fusing device 1. In this case, a not-illustrated non-fused toner image is applied to printing material 4. Printing material 4, including the non-fused toner image, is transported along a transport direction 5 on its transport path through fusing device 1, as indicated by an arrow. To achieve this, not-illustrated advance and guiding elements are provided.

Through slits 6 and 7, printing material 4 is passed through fusing device 1. Fusing device 1 comprises a microwave applicator 2, in which not-illustrated microwave radiation is applied to printing material 4. To achieve this, printing material 4 passes through microwave application zone 3 of microwave applicator 2. To do so, slits 6, 7 are provided in panels 11, 12 of microwave applicator 2. Through slits 6, 7, microwave radiation may exit microwave application zone 3. This is the so-called leakage radiation which is no longer available to the application process, i.e., the fusing process, inside microwave applicator 2.

Irradiation devices configured as gas-discharge lamps 8, 9 are provided outside microwave applicator 2. In so doing, viewed in transport direction 5 of printing material 4, a gas-discharge lamp 8 is located upstream of microwave applicator 2 and, viewed in transport direction 5 of said the printing material 4, a second gas-discharge lamp 9 is located downstream of microwave applicator 2. In this case, gas-discharge lamps 8, 9 represent absorber elements which absorb microwave radiation exiting, for example, through slits 6, 7 from microwave application zone 3 of microwave applicator 2. Gas-discharge lamps 8, 9 are filled with gas which is excited by the absorbed microwave radiation to emit electromagnetic radiation. In the case illustrated here, gas-discharge lamp 8 is energized to emit electromagnetic radiation predominantly in the infrared region of the spectrum. Gas-discharge lamp 9 is energized by microwave radiation which substantially exits through slit 7 of microwave application zone 3 in order to emit radiation predominantly in the ultraviolet region. A selection of the spectral emission region of gas-discharge lamps 8, 9 is achieved, in so doing, via the selection of the gas with which gas-discharge lamps 8, 9 are filled.

As mentioned, toner particles lie unfixed on printing material 4. Printing material 4 may be a sheet of paper, for example. Viewed in transport direction 5 of printing material 4, the printing material 4 is first passed under gas-discharge lamp 8. Infrared radiation preheats the toner or the printing material 4. In microwave application zone 3 of microwave applicator 2, the printing material 4 is heated by microwave radiation such that sufficient heat is transferred to the preheated toner, in order to cause the toner to fuse. The toner, which is fused to printing material 4, is moved out of the microwave application zone 3 through slit 7, at which time ultraviolet radiation of gas-discharge lamp 9 acts on the toner. As a result, the fusing process of toner to printing material 4 is completed. In an advantageous manner, the toner may be cross-linked by UV radiation in this case. This causes the ultraviolet radiation to trigger a chemical reaction of the toner, which, in addition to fusing, causes the toner to undergo a chemical change in such a manner that it is cross-linked on printing material 4. Consequently, a particularly stable printed image is created on printing material 4. This printed image cannot be damaged, for example, by the renewed application of microwave radiation from a microwave applicator 2. This is of particular advantage regarding the quality of the printed image when a duplex printing process used.

FIG. 2 shows a diagram of a side elevation of a fusing device 1, which comprises sliding gas-discharge lamps 8 and 8' provided outside a microwave applicator 2. The same reference numbers as in FIG. 1 are used for the same elements. In the embodiment shown here, gas-discharge lamps 8 and 8' are energized by microwave radiation exiting from microwave application zone 3 of microwave applicator 2 in order to emit electromagnetic radiation. In this case, microwave radiation may exit, for example, through slit 6 in panel 12 of the microwave applicator 2. By energizing gas-discharge lamps 8, 8' with the use of exiting microwave radiation, this leakage radiation may be used in a favorable manner to at least aid the fusing process. In addition to gas-discharge lamps 8, 8', which represent absorber elements absorbing exiting microwave radiation, this configuration comprises filter structures 10. These filter structures 10 can further reduce leakage radiation in a larger perimeter of fusing device 1.

A microwave field exists between individual filter structures 10. As depicted here, gas-discharge lamps 8, 8' can be moved along a slide 23. In the case shown here, shifting takes place in a direction parallel to transport direction 5 of printing material 4. However, shifting in a direction perpendicular thereto is possible. Generally, microwave radiation intensity decreases as the distance from microwave applicator 2 increases. Consequently, by sliding gas-discharge lamps 8, 8', the intensity of microwave radiation acting on gas-discharge lamps 8, 8' can be regulated. The electromagnetic radiation emitted through gas-discharge lamps 8, 8' is directly correlated with the intensity of the microwave radiation acting on the gas-discharge lamps 8, 8'. Depending on the density or thickness of a toner layer on printing material 4, electromagnetic radiation with appropriately adapted intensity may act on the toner. In the case illustrated here, the emitted electromagnetic radiation is infrared radiation. Consequently, depending on the toner density, a gas-discharge lamp 8 or 8' can be shifted into regions of appropriate field strength of the exiting microwave radiation. In this manner, the emitted infrared radiation is adapted to the density or thickness of the toner material. As a result of this, the toner is preheated even before it enters microwave application zone 3. Less microwave radiation is required for further fixing the toner; generally, the energy required for generating microwave radiation is utilized better. Not illustrated in this figure but equally possible are additional or alternative gas-discharge lamps 9, 9', which, viewed in transport direction 5 of printing material 4, are located downstream of microwave applicator 2. As already explained regarding FIG. 1, these gas-discharge lamps 9, 9' may emit UV radiation, for example, and thus at least aid the fixing process or, if cross-linkable toners are used, cross-link the toner on the surface of printing material 4.

FIG. 3 is a schematic illustration of fusing device 1, which comprises a microwave applicator 2 having different panels 11, 12. Again, the same elements have the same reference numbers as in the previous figures.

Printing material 4 having a not-illustrated toner layer is passed along transport direction 5 through microwave application zone 3 of microwave applicator 2. Gas-discharge lamps 8, 8' and 9, 9' are provided upstream and downstream of the microwave application zone 3. Gas-discharge lamps 8, 8' provided upstream of microwave application zone 3 absorb microwave radiation, which exits through slit 6 from microwave application zone 3, and emit—due to being energized by microwave radiation—infrared radiation that preheats the toner on printing material 4. Gas-discharge lamps 9, 9' provided downstream of microwave application zone 3 absorb microwaves which exit through slit 7 of microwave applicator 2, and emit UV radiation, which at least aids the fusing process of the toner to the printing material 4, or, if toner that can be cross-linked by UV radiation is used, cross-links the toner on the surface of printing material 4.

Depending on the density or thickness of the toner on printing material 4, different infrared radiation and/or UV radiation intensities are required. These required intensities of emitted radiation can be achieved by changing the intensities of gas-discharge lamps 8, 8', 9, 9'.

The intensity of microwave radiation exiting through slits 6 and 7 is a function of the slit height of slits 6 and 7. Depending on the required intensity of the microwave radiation, panels 11, 12 of microwave applicator 2 are moved along slides 13 and 14. In this manner, the slit height of slits 6 and 7 may be adapted, and more or less microwave radiation may exit from microwave application zone 3. In particular, it is possible to slide these panels 11, 12 of microwave applicator 2 in different ways. Advantageously, in order to energize gas-discharge lamps 8, 8', 9, 9', more microwave radiation should exit from slits 6 and 7 than in a comparable fusing device 1, which comprises absorber elements that are not configured as gas-discharge lamps 8, 9. Consequently, in the illustrated case, the probability of collisions of printing material 4 with lateral panels 11, 12 of microwave applicator 2 is minimized.

FIG. 4 shows a fusing device 1 with sliding filter elements 15. The same reference numbers are used for the same elements as in the previous description of the figures. As in the previous description of the figures, a printing material 4 is passed along a transport direction 5 through a microwave applicator 2 of the fusing device 1. In this case, in the zone upstream of microwave application zone 3 of microwave applicator 2, gas-discharge lamps 8, 8' are provided which absorb microwave radiation exiting from slit 6 and emit electromagnetic radiation in particular in the infrared region. Various filter structures 10 may be provided in the perimeter outside microwave applicator 2. In particular, it may also be possible to provide gas-discharge lamps 9, 9' (not shown in this drawing) on the side downstream of microwave applicator 2.

In the zone of gas-discharge lamps 8 and 8' upstream of microwave applicator 2, two sliding filter elements 15 are provided which can be moved along slides 16 and 17. The direction of this shift is perpendicular to the plane of the transport direction 5 of printing material 4. However, other embodiments are conceivable, in which case slides 16, 17 are located on a plane parallel to transport direction 5.

The intensity of microwave radiation exiting through slit 6 is affected by the positions of filter structures 10 and filter elements 15. Thus, a higher intensity of microwave radiation acts on gas-discharge lamps 8, 8' if filter elements 15 are moved away from the plane of the transport path of printing material 4. A movement toward the plane of the transport path represents a reduction of the intensity of the microwave radiation acting on gas-discharge lamps 8, 8'. As described above, this affects the intensity of the infrared radiation emitted by gas-discharge lamps 8, 8'. It is also possible to provide adjustable filter elements on the side of microwave applicator 2, the filter elements being located downstream of the microwave applicator 2, viewed in the transport direction 5 of printing material 4. In this case, the intensity can be affected by electromagnetic radiation, e.g., UV radiation emitted by gas-discharge lamps 9, 9'. In this manner, the infrared radiation and UV radiation can be adapted advantageously to the thickness or density of the toner.

FIG. 5 shows a fusing device 1 which is substantially similar to the fusing devices described in the previous figures. In addition, or alternatively, this fusing device 1 comprises a coupling element 18 in a panel 12 of microwave applicator 2, the panel 12 being able to stop microwave radiation from microwave application zone 3 of microwave applicator 2 in the zone outside microwave applicator 2 in the vicinity of a gas-discharge lamp 8. The coupling element 18 shown here is an electrical conductor 18. In an alternative embodiment, a diaphragm could be provided which, as a function of its diameter, can stop microwave radiation from microwave application zone 3 in the zone of gas-discharge lamp 8.

Depending on the length with which electrical conductor 18 extends into microwave application zone 3, microwave radiation from microwave application zone 3 is guided into the zone outside microwave applicator 2. This microwave radiation then acts, in addition to microwave radiation exiting from slit 6 of microwave applicator 2, on gas-discharge lamp 8 and energizes the gas-discharge lamp 8 to emit infrared radiation. The farther electrical conductor 18 extends into microwave application zone 3, the greater is the microwave power that is removed from the microwave application zone 3. In this manner, the intensity of infrared radiation emitted by gas-discharge lamp 8 can also be increased. Correspondingly, the emitted infrared radiation can be reduced if electrical conductor 18 is retracted from the region of microwave application zone 3. In this way, an adaptation of infrared radiation acting on the toner on printing material 4 is possible. Not illustrated here, but covered by the inventive idea, are gas-discharge lamps 9 and 9', which are located on the side downstream of microwave applicator 2 and emit, for example, UV radiation having an intensity which can be regulated by means of a second electrical conductor 18 in panel 11.

FIG. 6 shows a fusing device 1 which is designed similarly as the previous fusing devices and which comprises diaphragms 19, 20, which can be adjusted around gas-discharge lamps 8, 8' and, in so doing, can reduce the intensity of microwave radiation acting on gas-discharge lamps 8, 8' as a function of the extent of shielding of the applied to gas-discharge lamps 8, 8'. To achieve this, diaphragms 19, are adapted cylindrically to the form of gas-discharge lamps 8, 8' and can be rotated about the gas-discharge lamps 8, 8'. In so doing, the diaphragms 19, 20 have an opening through which microwave radiation can act on gas-discharge lamps 8, 8'. Rotatable diaphragms 19, 20 can be slid in radial direction 21 and 22 about gas-discharge lamps 8, 8'. Depending on the position of the diaphragms 19, 20, more or less microwave radiation may act on gas-discharge lamps 8 and 8', and thus more or less infrared radiation is emitted by gas-discharge lamps 8 and 8'.

In particular, it is possible in the case of each described device modification to use electrodes to bias gas-discharge lamps 8, 8', 9, 9' and, by increasing or decreasing this bias, to adapt the emitted electromagnetic radiation to specific requirements. These requirements may refer to the layer thickness or density of a toner or, more generally, to a printing agent on printing material 4. If a thicker layer of toner material is on printing material 4, it may be necessary to allow more UV radiation or more infrared radiation to be emitted by gas-discharge lamps 8, 8', 9, 9'. This can be ensured by an increased bias. The intensity of the radiation can also be adapted to various types of printing agents and/or printing materials; the same may be achieved by adapting the composition of the gas of gas-discharge lamps 8, 8'. In particular, by favorably increasing the bias of gas discharge lamps 8, 8', 9, 9', the absorption properties of gas-discharge lamps 8, 8', 9, 9' regarding microwave radiation are improved.

Alternatively, it is also possible to use gas-discharge lamps 8, 8', 9, 9' which operate without electrodes. In this case, the gas of gas-discharge lamps 8, 8', 9, 9' is excited only by microwave radiation exiting from microwave applicator 2 for the emission of electromagnetic radiation.

Likewise, combinations of various device features as shown in FIGS. 1-6 are conceivable. In any event, the device features presented here can be used to improve the degree of effectiveness of fusing device 1 or, more generally, the heating device, because leakage radiation from the microwave applicator 2 exiting through slits 6, 7 from microwave application zone 3 is not simply absorbed by absorber elements, but this absorbed microwave radiation can be utilized by gas-discharge lamps 8, 8', 9, 9' in that the microwave radiation is used to excite the gas of gas-discharge lamps 8, 8', 9, 9' in such a manner that the gas-discharge lamps 8, 8' and 9, 9' emit electromagnetic radiation which can be used for the fusing process or for heating a printing agent or a toner. In a particularly advantageous manner, the toner can initially be heated by infrared radiation, partially fused to printing material 4 by microwave radiation within microwave application zone 3, and finally cross-linked by UV radiation on printing material 4.

The invention claimed is:

1. A heating device for heating at least one printing agent on a printing material which is moved along a transport path through said heating device, the heating device comprising:

at least one microwave applicator and at least one microwave absorber element in an outer perimeter of the microwave applicator, wherein at least one microwave absorber element is an irradiation device which absorbs microwave radiation and emits electromagnetic radiation.

2. A heating device as in claim 1, wherein the irradiation device is a gas-discharge lamp.

3. A heating device as in claim 1, wherein the irradiation device is provided in a region of the transport path of the printing material upstream of the microwave applicator and is energized by exciting microwave radiation to emit electromagnetic radiation substantially in a visible region of a spectrum.

4. A heating device as in claim 1, wherein the irradiation device is provided in a region of the transport path of the printing material upstream of the microwave applicator and is energized by microwave radiation exiting from the microwave applicator for the emission of electromagnetic radiation substantially in an infrared region of a spectrum.

5. A heating device as in claim 1, wherein the irradiation device is provided in a region of the transport path of the printing material downstream of the microwave applicator and is energized by microwave radiation exiting from the microwave applicator for the emission of electromagnetic radiation substantially in a ultraviolet region of a spectrum.

6. A heating device as in claim 1, wherein a printing agent is used, which can be cross-linked by UV radiation.

7. A heating device as in claim 6, wherein the printing agent is a toner.

8. A heating device as in claim 1, wherein at least one adjustment element is provided for changing the microwave radiation acting on the irradiation device.

9. A heating device as in claim 1, wherein the emitted electromagnetic radiation is applied directly to the printing agent.

10. A method for heating or fixing a printing agent on a printing material that is moved along a transport path through a microwave applicator, the method comprising:

irradiating the printing material or the printing agent with microwave radiation from the microwave applicator, wherein the microwave radiation exits from the microwave applicator and is absorbed by a microwave absorber element;

emitting electromagnetic radiation by the microwave absorber element as a result of the absorption of the microwave radiation; and applying the electromagnetic radiation emitted by the microwave absorber element onto the printing agent or the printing material.

11. The method according to claim 10, wherein the electromagnetic radiation is applied directly to the printing agent.

* * * * *